US006863573B1

(12) United States Patent
Kohler

(10) Patent No.: US 6,863,573 B1
(45) Date of Patent: Mar. 8, 2005

(54) 120 VOLT TO 12 VOLT MR16 ADAPTER

(76) Inventor: Robert Lee Kohler, 1525 NW. 181st St., Edmond, OK (US) 73003

( * ) Notice: Subject to any disclaimer, the term of this patent is extended or adjusted under 35 U.S.C. 154(b) by 109 days.

(21) Appl. No.: 10/262,135

(22) Filed: Oct. 1, 2002

(51) Int. Cl.[7] ..... H01R 25/00
(52) U.S. Cl. ..... 439/646
(58) Field of Search ..... 439/646, 642, 439/628, 8, 739, 643; 362/421

(56) References Cited

U.S. PATENT DOCUMENTS 2,127,370 A * 8/1938 Sammut ..... 200/11 G
2,231,565 A * 2/1941 De Reamer et al. ..... 439/8
3,878,390 A * 4/1975 Feder ..... 362/260
4,459,648 A * 7/1984 Ullman ..... 362/307
5,320,548 A 6/1994 Schadhauser
5,356,314 A * 10/1994 Aota ..... 439/642
5,394,133 A * 2/1995 Harwood ..... 336/107
5,961,207 A * 10/1999 Petkovic ..... 362/376
5,989,070 A 11/1999 Al-Turki
6,162,100 A 12/2000 Al-Turki
6,328,593 B1 12/2001 Chang
6,582,253 B1 * 6/2003 Lau ..... 439/646

* cited by examiner

*Primary Examiner*—Phuong Dinh
(74) *Attorney, Agent, or Firm*—Randal D. Homburg

(57) ABSTRACT

The MR16 lamp adapter is an apparatus which allows for one to convert their 120 volt AC lighting device to a lower voltage AC light device by attachment of an Edison lamp base on one end of the apparatus within the Edison socket of the AC light device, the apparatus having an encased voltage converter within a non-conductive extension, reducing the voltage from 120 volt AC to the lower AC voltage. The apparatus has a lower voltage AC light socket with a bulb on the opposing end of the apparatus to accept a low voltage light bulb. This apparatus is most preferred for converting 120 volt AC recessed light canisters without incurring costly and difficult retrofitting of low voltage light device in the place of the existing 120 volt AC recessed light canisters, which may be placed in locations where access is restricted, confined or otherwise inaccessible.

2 Claims, 2 Drawing Sheets

120 VOLT TO 12 VOLT MR16 ADAPTER

CROSS REFERENCE TO RELATED APPLICATIONS

None

I. BACKGROUND OF THE INVENTION

1. Field of Invention

The MR16 lamp adapter is an apparatus which allows for one to convert their 120 volt AC lighting device to a lower voltage AC light device by attachment of an Edison lamp base on one end of the apparatus within the Edison socket of the AC light device, the apparatus having an encased voltage converter within a non-conductive extension, reducing the voltage from 120 volt AC to the lower AC voltage. The apparatus has a lower voltage MR16 light socket on the opposing end of the apparatus to accept a low voltage MR16 lamp. This apparatus is most preferred for converting 120 volt AC recessed light canisters to 12 volt AC MR16 bi-pin socket fixtures without incurring costly and difficult retro-fitting of low voltage light device in the place of the existing 120 volt AC recessed light canisters, which may be placed in locations where access is restricted, confined or otherwise inaccessible.

2. Description of Prior Art

The following United States patents were discovered and are disclosed within this application for utility patent. All relate to devices that adapt or convert light fixtures.

A first U.S. Pat. No. 6,162,100 to Al-Turki, is an adapter for converting an Edison socket to a bayonet socket, the disclosed device screwing into the Edison lamp base and having an internal socket adapted to accept a smaller screw base bulb. This device discloses no voltage conversion apparatus means. Likewise, U.S. Pat. No. 5,989,070 to Al-Turki discloses a device to adapt an Edison lamp base to a bayonet bulb, a bayonet base to an Edison bulb, an Edison lamp base to a compact fluorescent bulb, a compact fluorescent base to an Edison bulb, and so forth. However, at no time is a voltage reduction or enhancement noted, nor is there a device disclosed to perform such conversion. In both inventions, bulbs of like voltage must be the only bulbs converted, and only the bases are adaptable.

In U.S. Pat. No. 5,320,548 to Schadhauser, and adapter is defined to convert an Edison lamp base fixture into a compact fluorescent lamp by the inclusion of the disclosed device, which includes mention "circuit elements" of a circuit element or ballast circuit for the operation of the low-pressure discharge lamp, and also discloses an inductive ballast in lieu of an "electronic starting-and-operating circuit". However, this device does not adapt a bi-pin, low voltage bulb, nor does it contain a 120 volt to 12 volt converter attaching between the Edison lamp base and a bi-pin socket, specifically 12 volt AC bi-pin socket, as disclosed and claimed in the current invention.

II. SUMMARY OF THE INVENTION

The primary objective of the invention is to provide an apparatus to convert a 120 volt Edison lamp base light fixture or lamp into a low-voltage bi-pin socket to accept a bi-pin bulb. More specifically, the objective of the invention is to convert the 120 volt AC Edison lamp base light fixture to a 12 volt AC bi-pin light fixture.

A second objective of the invention is to provide the apparatus to be placed within a recessed lighting ceiling fixture or ceiling canister to convert the 120 AC volt fixture into a 12 volt AC fixture to conserve electrical energy, reduce heat output from the bulb and to reduce the risk of overheating of the fixture within the ceiling which can result in fire.

A third objective of the invention is to provide the 12 volt AC bi-pin socket in a multi-positional embodiment to better aim and focus the light emitted from the 12 volt AC bi-pin light bulb for better control over the aesthetics of the area to be illuminated by the bi-pin light bulb, such bi-pin light bulbs available in a variety of lumen outputs, wattage, and focal projection.

III. DESCRIPTION OF THE DRAWINGS

The following drawings are submitted with this utility patent application.

IV. DESCRIPTION OF THE PREFERRED EMBODIMENT

In many homes and business structures, certain limited lighting fixtures may be present in the structure, depending upon the time that the structure was built. In may instances, the lighting fixtures may be of the type installed within the structure which are either inefficient, produce high amounts of heat, sometime enough to pose a fire hazard, or the lighting fixtures no longer accomplish the aesthetic needs of the owner of the structure. Replacement of the lighting fixtures may be costly, difficult, or in some instances, nearly impossible without incurring substantial cost of remodel or without extensive damage to the wall or ceiling where the old lighting fixtures are located. This is most often the case with recessed lighting canisters, although other fixture may pose similar problems in replacement. In these instances, it would be most economically feasible to find a means of enhancing the economic efficiency of the fixture, reduce the risk of heat related hazards and also to enhance the aesthetic potential of the old fixture.

It has been found, in the lighting industry, that low voltage lighting fixtures, especially the 12 volt AC MR16 bi-pin fixtures and lamp bulbs, produce lower heat per lumen output than 120 volt AC Edison lamp bulbs, require lower electrical energy per lumen output and also produce substantially less heat than conventional 120 volt AC incandescent lamp bulbs per lumen. Therefore, an apparatus or device to convert a 120 volt Edison lamp base lighting fixture to a low voltage lighting fixture, specifically a 12 volt AC MR16 bi-pin socket and lamp, would allow for the conversion of the existing 120 volt Edison lamp base lighting fixture to obtain the advantages of the 12 volt AC MR16 bi-pin socket and lamp features.

Figure 1:
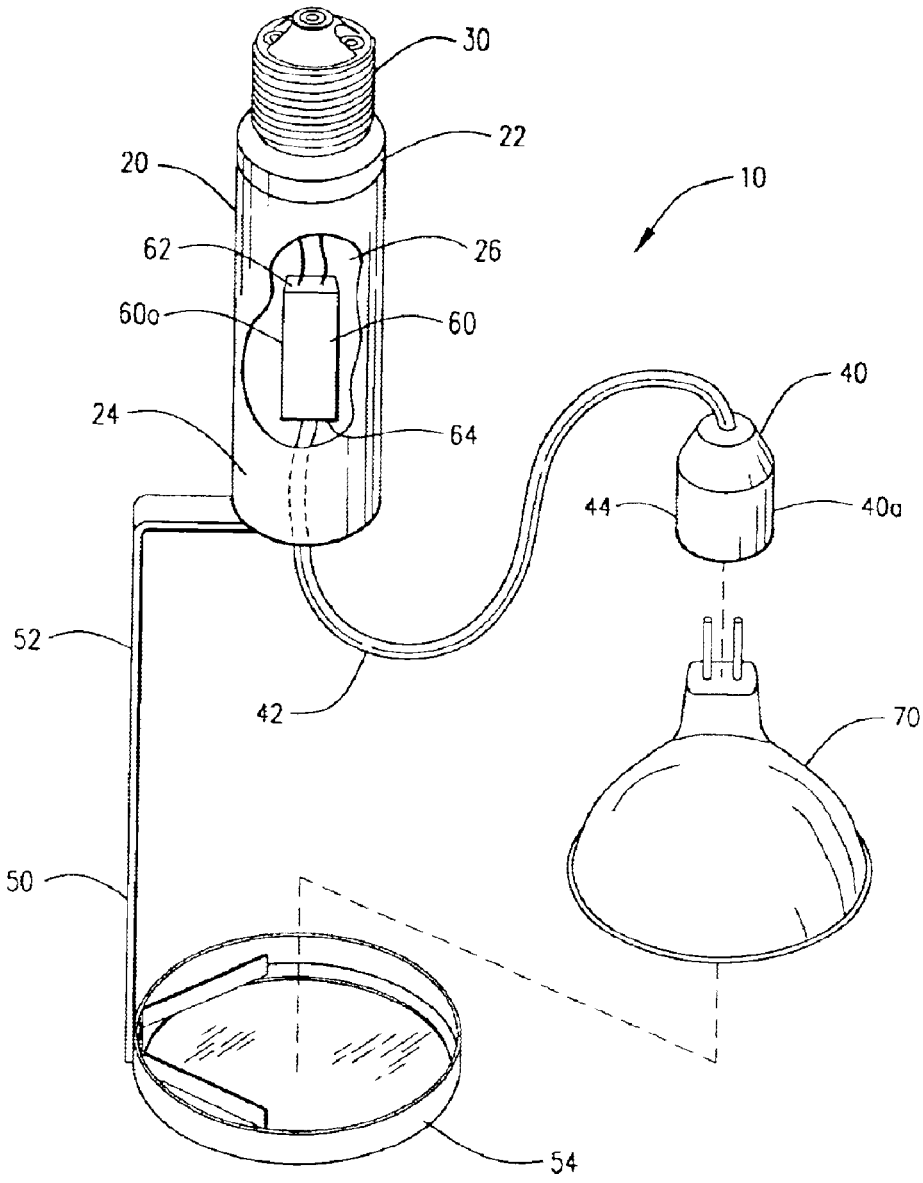
FIG. 1 is an extended drawing of the components of the apparatus.
Figure 2:
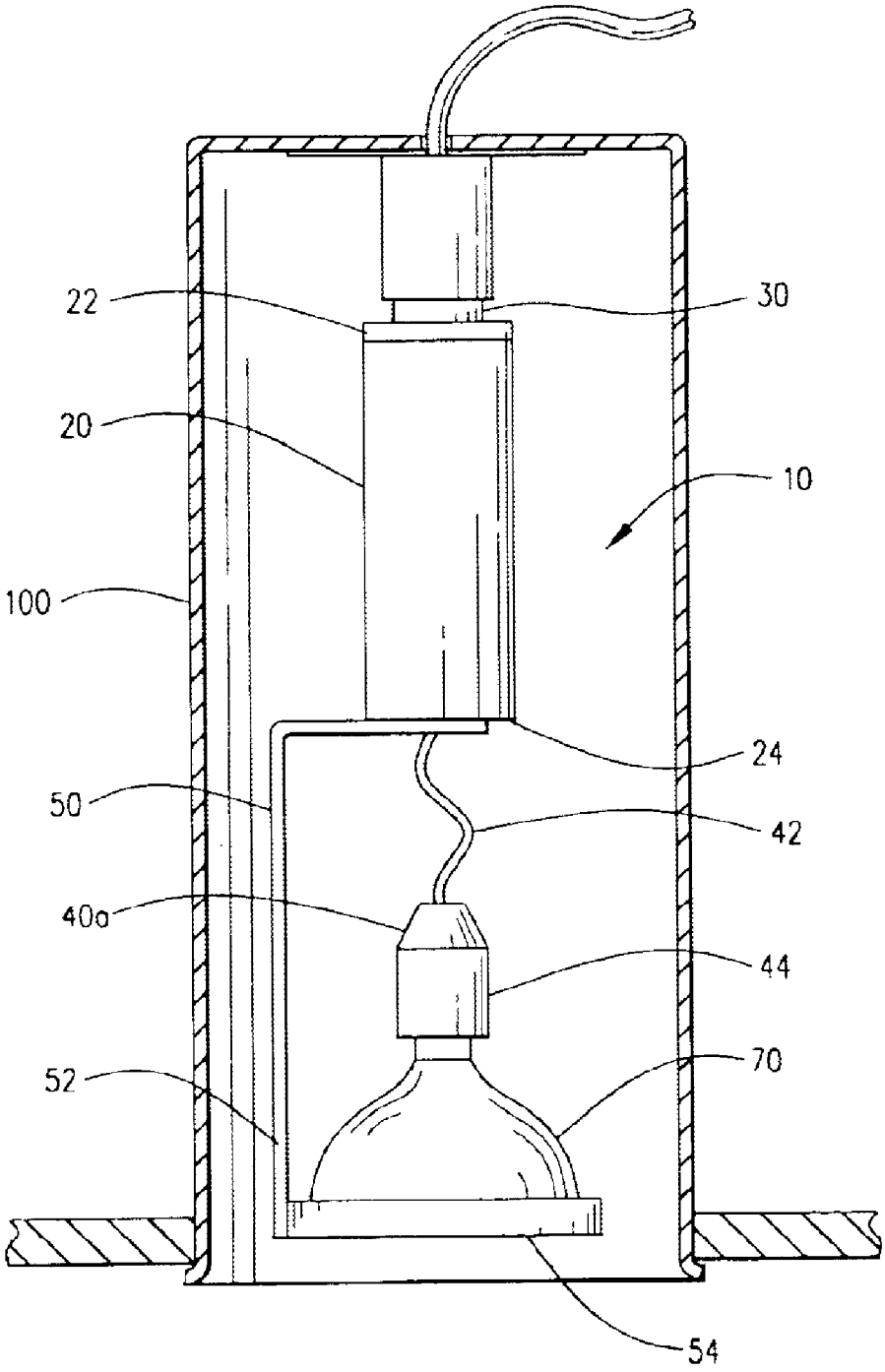
FIG. 2 is a cross section of the apparatus contained within a recessed canister light fixture.

The MR16 lamp adapter, shown in FIGS. 1 and 2 of the drawings, is an apparatus which adapts and converts a 120 volt AC Edison lamp base lamp or Edison lamp base fixture to a low voltage AC lamp base, primarily an MR16 bi-pin socket, the apparatus 10 comprising an non-conductive stem 20 having an interior 26, a first end 22, and a second end 24, the first end 22 providing an externally threaded 120 volt AC Edison lamp base 30, the second end 24 providing a low voltage AC socket 40, with the Edison lamp base 30 and the low voltage AC socket 40 connected together through a 120 volt AC to low voltage converter 60, the converter 60 contained within the interior 26 of the non-conductive stem 20.

In a preferred embodiment, specifically shown in FIGS. 1 and 2, the apparatus 10 provides the 120 volt AC Edison lamp base 30 to a 12 volt AC MR16 bi-pin socket 40*a* through the incorporation of a 120 volt AC to 12 volt AC converter 60*a* having a high voltage terminal 62 wired to the Edison lamp base 30 and a low voltage terminal 64 wired to the 12 volt AC MR16 bi-pin socket 40*a*. In this preferred embodiment, the apparatus 10 is shown as a preferred apparatus to convert a 120 volt AC recessed lighting canister 100, shown in FIG. 2, to use a 12 volt AC MR16 lamp to reduce electrical cost and reduce heat output.

In yet another preferred embodiment, as specifically shown in FIG. 1, the apparatus 10 may also include a light directing means 50 comprising a support bracket 52 extending from the second end 24 of the non-conductive stem 20, a lamp bulb support 54 pivotally attaching to the support bracket 52, and a flexible bi-pin MR16 socket plug wire 42 having a bi-pin MRI 6 socket attachment 44 accepting a 12 volt AC MR16 bi-pin lamp 70. The 12 volt AC MR16 lamp 70 should be of low wattage, preferably less than 50 watts, and may be of a type lamp bulb producing a limited area of projection where the illumination is to be focused on a particular spot or area for aesthetic effect.

In addition, it is contemplated within the scope of this invention that the apparatus 10 may convert other high voltage light fixtures to other low voltage lamp bulbs depending on the voltage converter utilized in the apparatus. It is also contemplated that the shape of the non-conductive stem 20 may be of any length, other than that shown in the drawings, and such non-conductive stem may also be of any shape, including square, triangular, oval, egg-shaped, round or of any aesthetic embodiment so long as the shape of the non-conductive stem would not interrupt or avoid the express purpose of the apparatus 10. In addition, the apparatus 10 may apply other light directing means 50, including a ball socket, a sliding bracket, an omnidirectional pivoting socket or a swivel.

While the invention has been particularly shown and described with reference to a preferred embodiment thereof, it will be understood by those skilled in the art that changes in form and detail may be made therein without departing from the spirit and scope of the invention.

What is claimed is:

1. An MR16 lamp adapter, adapting and converting a 120 volt AC Edison lamp base fixture to a low voltage AC base, the adapter comprising:

a non-conductive stem having an interior:

a first end including an externally threaded 120 volt AC Edison lamp base:

a second end including a low voltage AC socket with the Edison lamp base and the low voltage AC socket attaching through a 120 volt AC to low voltage converter located within the interior of the stem; and a light directing means comprising a support bracket extending from the second end of the nonconductive stem, a lamp bulb support pivotally attaching to the support bracket, and the low voltage AC socket comprising a flexible bi-pin socket plug wire having a bi-pin socket attachment accepting a low wattage 12 volt AC MR16 bi-pin lamp bulb.

2. An MR16 lamp adapter, adapting and converting a 120 volt AC Edison lamp base fixture to a low voltage AC MRI 6 base, the adapter comprising:

a non-conductive stem having an interior, a first end including an externally threaded 120 volt AC Edison lamp base, and a second end;

a 120 volt AC to 12 volt AC converter located within the interior of the stem;

a light directing means comprising a support bracket extending from the second end of the nonconductive stem with a lamp bulb support pivotally attaching to the support bracket; and a flexible MR16 bi-pin socket plug wire having an MR16 bi-pin socket attachment accepting a low wattage 12 volt AC MR16 bi-pin lamp bulb, the 120 volt AC to 12 volt AC converter having a high voltage terminal wired to the Edison lamp base and a low voltage terminal attaching to the flexible MR16 bi-pin socket plug wire.

* * * * *